US005531418A

United States Patent [19]

Lindgren

[11] Patent Number: 5,531,418

[45] Date of Patent: Jul. 2, 1996

[54] LINE ATTACHMENT MEANS AS FOR A CHEMICAL LIGHTSTICK

[76] Inventor: Peter B. Lindgren, 4491 Crystal lake Dr., Apt. 205A, Pompano Beach, Fla. 33064

[21] Appl. No.: 271,476

[22] Filed: Jul. 7, 1994

[51] Int. Cl.[6] ..... A47H 1/10

[52] U.S. Cl. ..... 248/317; 24/301; 135/120.4

[58] Field of Search ..... 248/317, 220.21, 248/61, 544; 24/300, 301, 715.3, 130, 129 W; 289/18.1; 135/114, 118, 119, 120.4

[56] References Cited

U.S. PATENT DOCUMENTS 612,636 10/1898 Zusi ..... 135/120.4 X 928,469 7/1909 Miles ..... 135/120.4 X 3,374,509 3/1968 Logan et al. ..... 24/130

4,195,651 4/1980 Watts et al. ..... 135/120.4 X

*Primary Examiner*—Ramon O. Ramirez

*Assistant Examiner*—Michael J. Turgeon

[57] ABSTRACT

A line attachment device comprising a flattened piece of flexible material has a bottom section, a center neck section and a top section. The top section forms an invertible flap which in pivotal about the neck section. A line attachment device of this type may be connected to a chemical lightstick. When a line is pulled through the flap of the line attachment device and upward, it causes the flap to invert and "lock down" on the line thereby securing it to the lightstick.

4 Claims, 2 Drawing Sheets

LINE ATTACHMENT MEANS AS FOR A CHEMICAL LIGHTSTICK

FIELD OF THE INVENTION

The present invention relates to a line attachment means. More particularly, the present invention relates to a line attachment means or component for a chemical lightstick.

BACKGROUND OF THE INVENTION

Chemical lightsticks were originally designed as articles for providing a light source in flammable environments where conventional temporary light sources such as flashlights using heated filaments could be dangerous. The lightstick principally comprises a breakable glass ampule sealed within a flexible polyethylene injection molded tubular component. The ampule and the tubular component each contains a chemical composition which, when mixed together, results in a chemical light. The admixing of the chemicals necessarily requires breakage of the ampule while the tensile strength of the tubular component is sufficient to retain it sealed integrity and the chemical mixture.

Chemical lightsticks have found application in the commercial and recreational fishing industries. It has been found that the chemical light produced by admixing the chemicals contained in the ampule and tubular component of the lightstick, when attached to the line of a baited hook, attracts the fish to the hook and enhances the likelihood of the catch. The chemical lightstick has usually been attached to the hookline above the hook and bait with a rubberband or string. The rubberband or string would be threaded through a hole provided in the injection molded tubular component and then tied to the fishing line.

There is a difficulty, however, in attaching the lightstick to the fishing line using a rubberband or string. Typically, when applied to the commercial fishing, most such fishermen use gloves which limit their manipulative digit dexterity. Further, for both commercial and recreational fisherman, the nature of fishing oftentimes causes their hands to become slippery or slimy which again reduces their ability to manipulate smallish objects with their fingers. Finally, still another disadvantage of attaching a chemical lightstick to a fishing line by means of a rubberband or string is that these means can and do break causing loss of the light source about the baited hook and thus, a reduced catching ability.

Others have attempted to resolve the problems caused by the conventional rubberband attachment method of a lightstick to a fishing line. For example, U.S. Pat. No. 5,213,405 to Giglia, teaches a method of attachment. The drawback to the Giglia device, however, resides in the functioning ability of that device to remain at a predetermined distance from the baited hook without sliding to and fro in the water and its inherent cost of production.

SUMMARY OF THE INVENTION

The present invention overcomes the aforementioned difficulties of the prior art by providing a line attachment means for a lightstick that can be easily manipulated by a gloved or non-gloved fisherman or other wearer, that remains at a predetermined position on a line, and that is inexpensive to produce. The line attachment means comprises a flattened piece of flexible material for forming the top of the tubular component of a chemical lightstick. The flattened area may have a plurality of slots cut therein. A first set of slots forms a T-shape where the longer slot is positioned along the same axis as the lightstick and the smaller slot has an axis perpendicular to the lightstick and is contiguous with the first slot. This smaller slot forms the T-shape and terminates at both ends thereof in eyelets each having a diameter greater than or equal to that of the diameter of the line intended to be inserted therethrough. A second set of side slots are parallel to the smaller T-shape slots yet below them and define a flap within which the smaller T-shape slots reside. The second set of side slots also defines a neck along the center section of the flexible material. These slots terminate inwardly with eyelets each having a diameter greater than or equal to that of the diameter of the to-be-inserted line.

A line is looped and inserted or threaded through the T-shaped slot and fitted around the bottom of the lightstick's tubular component. The line is pulled taught toward the flap by its free ends. The line fits within each eyelet above described causing the flap to invert about the neck of the flexible material and lock down on the line securing it to the lightstick.

Therefore, it is an object of the present invention to provide for a line attachment means for securing a device to a line.

It is another object of the present invention to provide for a lightstick and attachment means that may be easily manipulated by a fisherman who wears, or does not wear, gloves.

It is yet another object of the present invention to teach a line attachment means that can lock in line at a predetermined position.

It is still another object of the present invention to provide for a line attachment means that is easy to produce and is produced at a low cost.

IN THE DRAWINGS

The features embodying the present invention are illustrated in the accompanying drawing, forming a part of this application, in which.

Figures 1, 2, 4:
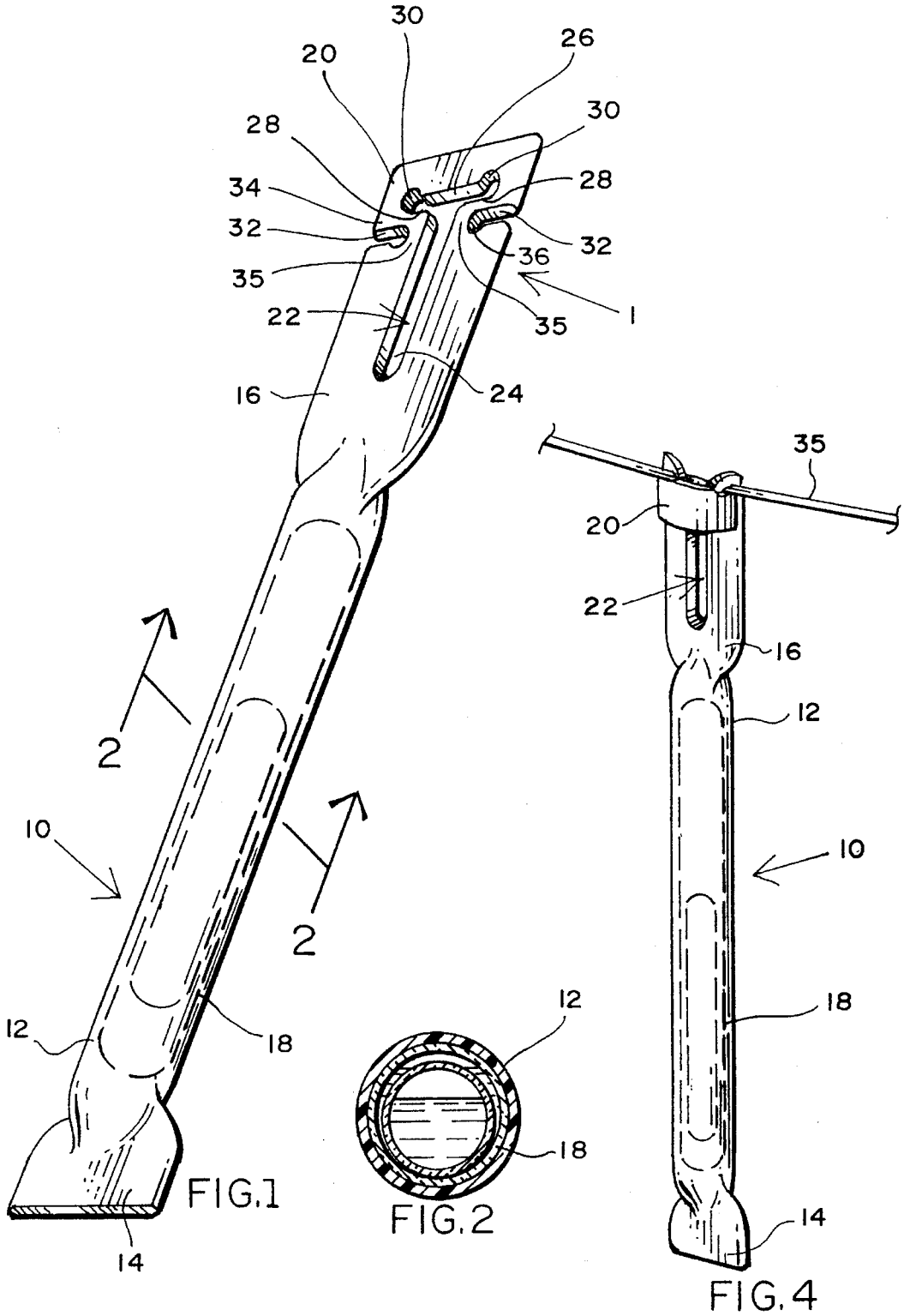
FIG. 1 is perspective view of the present invention attached to a lightstick.
FIG. 2 is a cross section view of FIG. 1 taken at line 2—2.
Figures 5, 6, 7:
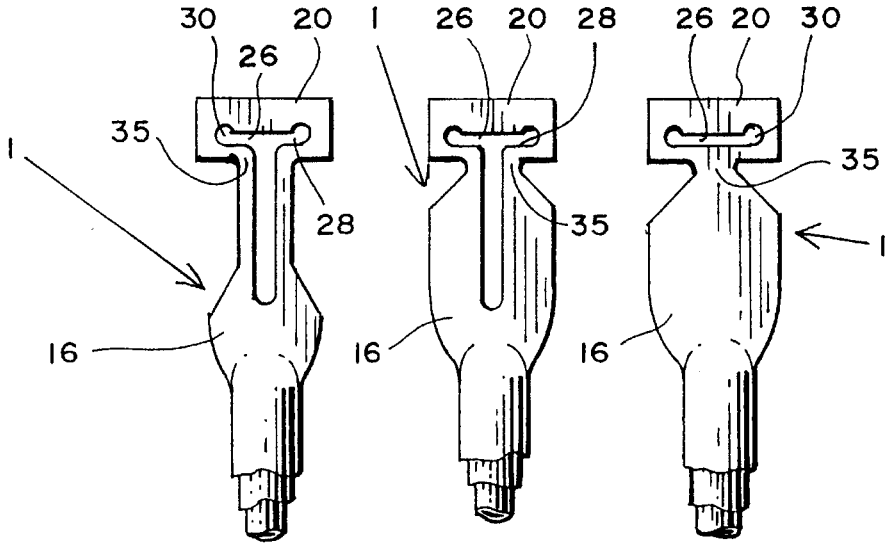

FIG. 3A–D are perspective, fragmented (in part) views of the present invention being operably connected to a line;

FIG. 4 is a perspective view of the present invention attached to a lightstick and secured to a line;

FIG. 5 is an alternative embodiment of the present invention;

FIG. 6 is another alternative embodiment of the present invention, and;

FIG. 7 is still another alternative embodiment of the present invention.

DESCRIPTION OF A PREFERRED EMBODIMENT

FIG. 1 depicts a preferred embodiment of the line attachment means or component 1 attached to a lightstick 10. The lightstick 10 comprises a tubular component 12 and is sealed at its bottom 14 and its top 16. The top 16 of the lightstick 10 is also the bottom section of the line attachment means 1. Each of the bottom 14 and the top 16, when sealed, is flat. The tubular component is injection molded or die cut of any acceptable synthetic material, such as polyethylene, that can produce a strip of flexible material. The sealing of the bottom 14 or top 16 may be achieved by conventional means well known in the art such as by sonic welding or by heat sealing.

The lightstick 10 further comprises a breakable glass ampule 18. A chemical composition, for example, oxalate ester and a fluorescer, may be contained within the ampule 18 which itself is contained within the tubular component 12. The ampule 18 is immersed in a chemical composition which may contain, for example, an activator, such as hydrogen peroxide, within the tubular component 12 of the lightstick 10 and physically separated thereby as shown in FIG. 2.

In order to activate the chemical light, each separate chemical composition contained within the ampule 18 and the tubular component 12 is mixed together by breaking the glass ampule 18. However, the tubular component 12 of the lightstick 10 is manufactured of conventional tensile strength to permit the ampule 18 to be broken without having the tubular component's sealed condition breached. Thus, after the breaking of the ampule 18, the separate chemical compositions are mixed and contained with the sealed tubular component 12. The mixed chemicals react producing a chemical light.

The line attachment means 1 is flat and terminates in a flap 20. The line attachment means 1 has a thickness which typically ranges from no less that 0.5 times and no more than 3.0 times that of the diameter of a line intended to be inserted or threaded therethrough (hereinafter referred to as "line diameter"). The line attachment means 1 may have a plurality of slots as can be seen in all the figures, and especially FIGS. 5–7 which show alternative embodiments of the present invention.

In the preferred embodiment shown in FIGS. 1, 3A–D and 4, a first set of slots forms a T-shape 22 comprising a longer slot 24 along the axis of the lightstick 10 and a shorter slot 26 which is contiguous with, and perpendicular to, the longer slot 24 and forms the T-shape 22. The shorter slot 26 has ends thereof 28 which terminate outwardly from the T-shape 22 in eyelets 30 having a diameter equal to 1.0 to 3.0 times that of the line diameter intended to be threaded through the slot. The eyelets 30 are also spaced apart 2.0 to 10.0 line diameters. It is noted here that each of the alternative embodiments in FIGS. 5–7 also have the same short slot 26, ends 28 and eyelets 30. Further the short slot 26 is part and parcel of the flap 20.

Continuing with the preferred embodiment, a second set of side slots 32 define the lower edge 34 of flap 20 and neck 35 located on a center section of the line attachment means 1. The slots 32, which are parallel with the short slot 26 of the T-shape 22, and spaced apart therefrom 0.5 to 3.0 line diameters, have eyelets 36 terminating inwardly toward the T-shape 22. These eyelets 36, like eyelets 30, have a diameter equal to 1.0 to 3.0 line diameters, and are spaced apart from each other by 1.0 to 10.0 line diameters.

Figures 3A, 3B, 3C, 3D:
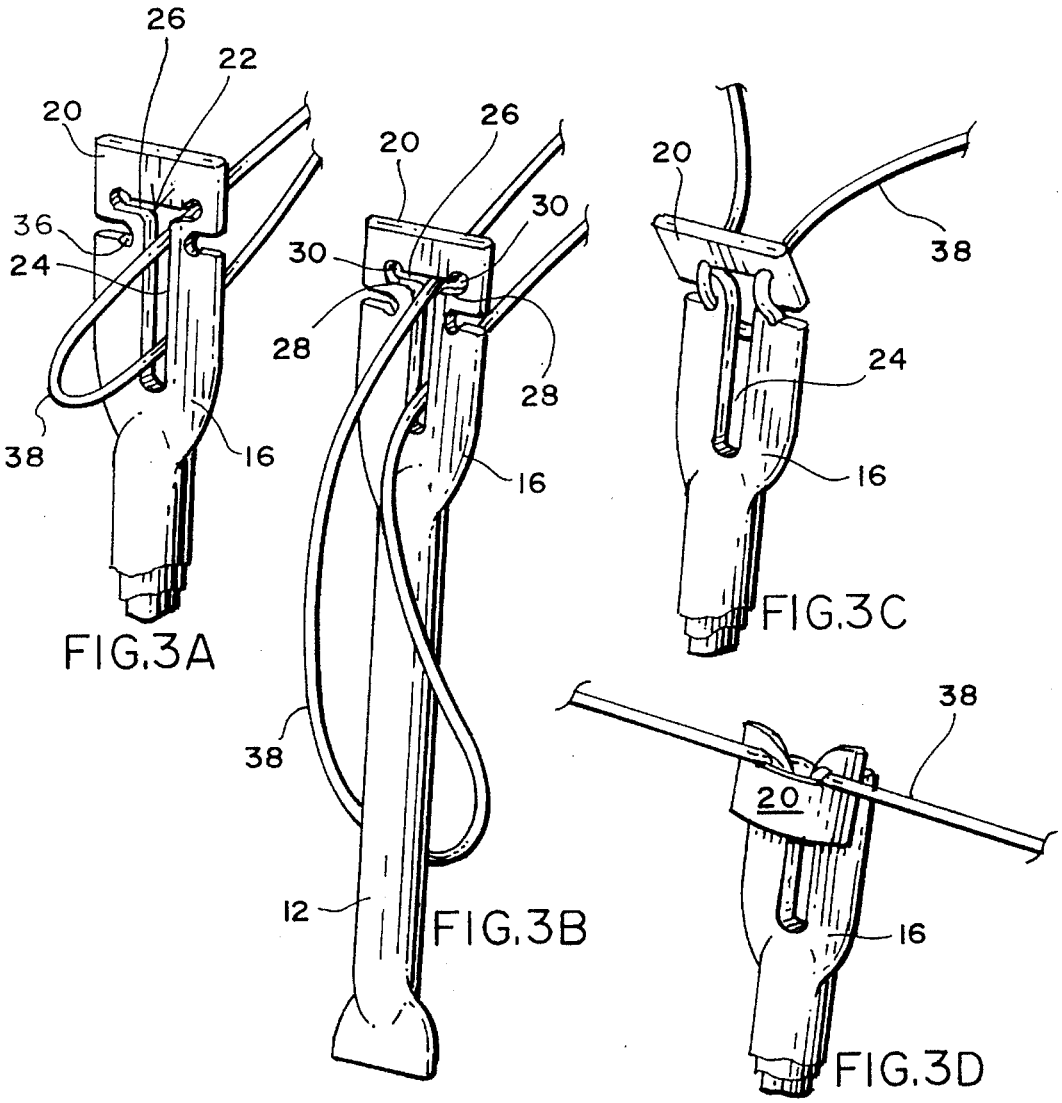

FIGS. 3A–D and 4 show the present invention in operation. Line 38 is looped and threaded or inserted through the T-shaped slot 22. The loop is wrapped around the lightstick 12 by bringing the line 38 around and over the bottom 14 of lightstick's tubular component 12. The free ends of line 38 are pulled upward towards the top 16 and flap 20 in a taught fashion, causing the line 38 to fit within the eyelets 30 and 36, and further causing the flap 20 to invert about the neck 35 of line attachment means 1 and "lock" the line 38 into place (FIGS. 3D and 4).

The alternative embodiments shown in FIGS. 5–7 of line attachment means 1 depict different configurations of the preferred embodiment. Common structure, however, includes, but is not limited to, flap 20, slot 26 and neck 35 sufficient to permit line 38 to be inserted through the line attachment means 1, wrapped about said means 1 at its bottom 16, and pulled taught causing the flap 20 to invert at the neck 35 section.

It is intended that the description of the preferred embodiments of this invention is illustrative only. Other embodiments of the invention that are included within the scope and concept of this invention are herein included within this application.

What is claimed is:

1. A line attachment means comprising, in combination, a line;

a flexible material having a bottom section, a center section, and a top section defining a flap;

a first set of two slots forming a T-shape where one of said two slots is positioned on the said flap and having eyelets terminating outwardly thereon of said T-shape, said eyelets having a diameter greater than or equal to that of a line intended to be threaded therethrough, and;

a second set of side slots defining a neck on the said center section, where said slots terminate inwardly in eyelets having a diameter greater than or equal to that of a line intended to be threaded therethrough.

2. In the line attachment means of claim 1, said flexible material being formed in the shape of a strip.

3. In the line attachment means of claim 1, said flexible material being substantially flat.

4. In the line attachment means of claim 1, where said eyelets of said first and second set of slots have a diameter in a range of 1.0 to 3.0 line diameters.

* * * * *